United States Patent [19]

Salomon

[11] 4,268,931

[45] May 26, 1981

[54] PROCESS OF MANUFACTURING AN INNER BOOT

[75] Inventor: Georges P. J. Salomon, Annecy, France

[73] Assignee: Etablissements Francois Salomon et Fils, Annecy, France

[21] Appl. No.: 843,381

[22] Filed: Oct. 19, 1977

[30] Foreign Application Priority Data

Oct. 21, 1976 [FR] France ..... 76 31719

[51] Int. Cl.[3] ..... A43D 9/00; A43B 5/04; A43B 3/10

[52] U.S. Cl. ..... 12/146 R; 12/142 P; 36/117; 36/10

[58] Field of Search ..... 12/142 R, 142 P, 146 R; 36/117, 118, 119, 120, 121

[56] References Cited

U.S. PATENT DOCUMENTS

| | | | |
|---|---|---|---|
| 3,645,017 | 2/1972 | Hickmann | 36/120 |
| 3,896,202 | 7/1975 | Palau | 36/117 |

FOREIGN PATENT DOCUMENTS

| | | | |
|---|---|---|---|
| 2230155 | 12/1974 | France | 36/118 |

*Primary Examiner*—Patrick D. Lawson
*Attorney, Agent, or Firm*—Pollock, Vande Sande & Priddy

[57] ABSTRACT

The present invention concerns an article of footwear to be placed inside a ski boot, and the process of its manufacture.

The process according to the invention is characterized by the fact that the article of footwear is molded in its open position, thereby permitting the inner core to be conveniently removed from the mold.

9 Claims, 9 Drawing Figures

FIG. 4
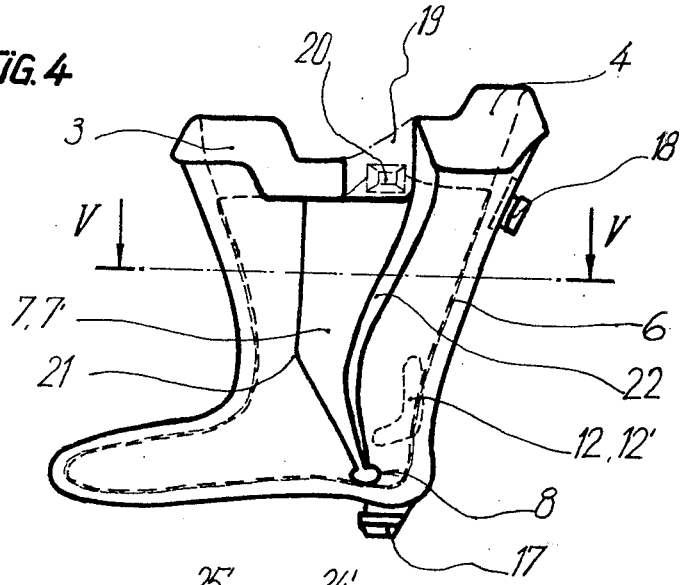
FIG. 5
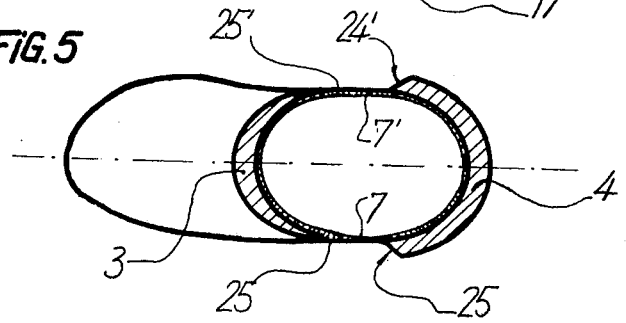
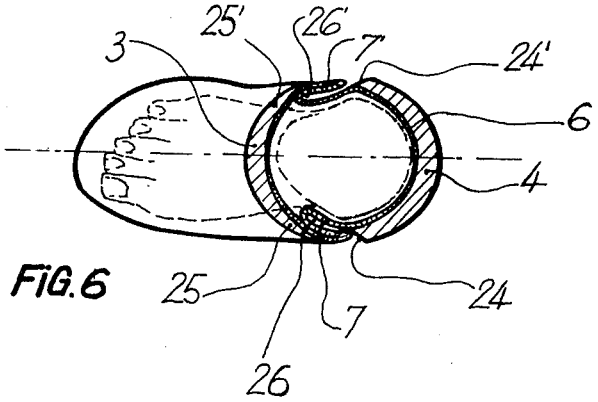
FIG. 6

PROCESS OF MANUFACTURING AN INNER BOOT

The present invention relates to an article of footwear, more particularly to be placed inside a ski boot, and its a process for its manufacture.

It is well known, that the foot and leg of a skier must be kept in contact with the ski boot and the ski by means of a binding, so that, the skier can control the position of the ski in relationship to the body despite the considerable opposing forces exerted by the snow on the ski. The shoe, according to the invention, placed inside the boot, makes it possible to prevent the skier's foot and leg, pressed inside the boot, from becoming bruised.

Moreover, during those times when he is not actually skiing, the skier is forced to walk in ski boots that are heavy and unsuited for this activity. Thus, it is also desirable for him to be able to enjoy the comfort of removing his ski boots when he has finished skiing and to have warm, pliant, snow-proof shoes that are suitable for walking. The inner shoe of a ski boot is a possible solution which might ensure the skier's comfort when not engaged in skiing.

More specifically, the object of the present invention is the economical product (i.e., allowing mass-production) of shoes to be placed in ski boots to assure the comfort of the skier. This object could not be fully satisfied if costly and complex means had to be used.

In general, then, in order to attain the objective of the present invention, the shoe structure must be compatible with a mass-production process, on the one hand, and the mass-production process must be compatible with the shoe structure.

Various attempts have been made to achieve this goal. In one known approach, the problem consists of designing a shoe that can be injection-molded, permitting the stripping of the inner, foot-shaped core by opening the shoe after molding one known solution to this problem is to manufacture the shoe by:

(a) slipping a cloth sock over a foot-shaped core;

(b) placing a foot-shaped core inside a hollow, shoe-shaped mold;

(c) injecting synthetic material into the space provided between said core and said mold; and (d) cutting out slots in the shoe so that the shoe can be opened and the inner core removed.

This type of solution, as described in French patent application No. 2,221,092 and in French Pat. No. 2,047,650 solves the problem that has been posed, but has the following major drawbacks:

In the first place, the need to cut out slots in the shoe (in order to extract the inner mold) complicates the manufacturing process, because the walls of the mold must be so arranged that reference zones are produced on the shoe to serve as a guide and facilitate the cutting out of the slots, and a cutting operation must be included, and this can be costly.

Moreover, even if the slots facilitate removal of the core, the shoe still must be opened against the resilient action of the shoe-wall, which is not always convenient in a mass-production process.

Thus, the approach whereby stripping is accomplished by opening the shoe after molding would not appear to be the most favorable approach to attaining the objective posed, at least not on the basis of those solutions proposed thus far. Moreover, the existence of the slots, varying in shape and position, causes at least two additional disadvantages.

The slots are the origins of tearing that can occur from innumerable handlings during successive pulling-on and removal involving opening the shoe in the area of said slots. This disadvantage becomes fully evident in ski boots which open from the rear. In this case, the shoe has two lateral slots constituting the height of the shoe and thus dividing it into a front part and a rear part that pivots from the surface on which the skier's heel rests; the incipient tearing of the shoe in the heel area loosens the rear part of the whole, interfering with the skier's comfort and loosening the grip of the foot in the boot;

The slots not only do not prevent the entry of water or slush on the contrary, they encourage it. This water (slush) can seep into the boot when the skier maneuvers in deep snow, for example. Thus, not only is the approach of stripping from the mold by opening the shoe not the ideal approach, but known solutions also present drawbacks which interfere with the comfort of the skier.

In another known approach the problem consists of designing a shoe that can be molded by injection, allowing the inner, foot-shaped core to be removed from the mold without opening the shoe after molding.

One known solution to this problem consists of providing an inner core in several sections. It is obvious that this type of solution offers major drawbacks in light of the complexity of the mold to be developed and the complexity of the stripping operation itself, requiring the use of expensive equipment.

In view of the currently known solutions, this approach to the problem is not ideal either. The present invention proposes to attain the objective through an entirely different approach from those suggested heretofore, namely, by the designing a shoe that can be molded and which allows direct stripping of the inner core without irreversibly modifying the shape of the shoe or of the inner core, i.e., without the need for an additional operation for opening the shoe by cutting or disassembling the inner core.

This solution to the problem makes it possible to reach the objective proposed under optimal conditions and is better than the approaches suggested thus far, since it eliminates the costly operations required for cutting out the shoe and disassembling the core.

According to the invention, the manufacturing process of an article of footwear (shoe) to be placed in a boot includes the following steps, known in and of themselves:

(a) molding the article of footwear by placing a core inside a hollow mold having the inner shape of the boot, and by introducing a synthetic substance in the space left between said core and said mold;

(b) removing the article of footwear from the mold by extracting the inner core, said article of footwear being open in the shoe removal-reshoeing position.

The process is characterized by the fact that, (a) the inner core has a lower part in the shape of the foot and is extended by an upper part almost identical in shape to the volume delimited by the shoe open in the position for removing it and putting it back on (indeed, the volume corresponds for the most part to the space generated by the clearance of the lower part of the leg while walking), (b) the lower part of the hollow mold is shaped like the inside of the boot, while its upper part is relatively flared and corresponds to the open position for putting on and removing said article of footwear in such a way that, on the one hand, the operator can conveniently withdraw the inner core during the stripping operation, and, on the other hand, the skier can conveniently put on and remove the article of footwear.

In other words, the molding process according to the invention is characterized by the fact that the article of footwear is molded in the position for putting it on and removing it.

It is clear that the process according to the invention fully solves the problem passed, in that no additional operation whatsoever is necessary in order to withdraw the core from the shoe, so that the process is particularly suited to industrial mass-production. Moreover the shoe is directly obtained in the open position, i.e., in an especially stable position of maximum extension.

Preferably, and according to an additional characteristic of the invention which contributes vitally to the skier's comfort while allowing easy closure of the article when slipping it on, the latter includes a pliable zone composed of a pliable membrane linking the edges of the article bordering such zone.

It will be noted that this pliable membrane is not indispensable. For example as an alternative, notches could be provided, during molding (by adapting the mold to this end), particularly at the top, the rear and the sides. These notches would allow the article of footwear to take shape by drawing the separated parts (the edges of the notches) toward one another. The present invention is thus not limited to articles of footwear having a pliable zone.

It cannot be denied, however, that the presence of a pliable membrane between the parts of the article of footwear which are to be drawn together during the closing operation offers advantages in comparison with notches in particular: The nature of this pliable membrane is such that it will prevent any incipient break that could otherwise occur (e.g., in the case of a notch) in the pivoting area of the article during opening.

(b) Unlike notches, the pliable membrane helps assure the imperviousness of the article by preventing the entry of snow.

The article of footwear according to the invention and including a pliable membrane is specifically adapted for attaining mass-production, because it permits the inner core to be extracted directly, after molding.

The molding process according to the invention is perfectly suited for linking the edges of the article of footwear surrounding the pliable zone by a pliable membrane. This is accomplished by arranging a recess allowing passage of the pliable membrane between the inner core and the hollow mold on a level with the pliable zone.

One technique for producing the pliable membrane consists of slipping a sock over the inner core, with the thickness (or depth) of said recess at least equal to that of the sock. Alternatively, a recess which is thicker than the thickness of the sock can be provided, in which case the pliable membrane is composed in part of the sock and in part of the molded synthetic substance.

A second technique consists of the direct fabrication of the pliable membrane during molding by connecting the space between the core and the hollow mold to the recess. In this case, the thickness of the recess is preferably lower than that of the article of footwear so that an easily pliable, thin membrane can be obtained.

It should be observed, however, that the presence of a pliable membrane may interfere with the comfort of the skier in that it could produce folds and extra thicknesses. To guard against this, according to another characteristic of the invention, the edges of the mold, delimiting the pliable zone, receive additional bevelling; such that each pliable zone is delimited by the additionally bevelled edges. Preferably, each pliable zone is delimited by two bevelled edges, one directed inward toward the article of footwear, the other outward. Preferably, the bevelled edges are so arranged in relation to each other that, upon closing, the pliant membrane connecting the bevelled edges buckles inwardly toward the ski, becoming sandwiched between the bevelled edges. In this way, a thickness of material at most equal to that of the walls of the shoe upper is obtained in the overlapping zone between the bevels due to the fact that the pliable membrane is equal in length to the overlapping zone. Preferably, the article of footwear also includes two pliable zones arranged laterally along the lower part of the leg; this arrangement facilitates the closing of the article of footwear. It should be noted that, in this case especially, molding of the article in open position and the recess resulting therefrom produce an advantage that could otherwise be obtained only with a more complex, and thus more costly, mold. In fact, this recess, which is slightly larger for the bevel of the thicker wall (rear part) than for the bevel of the wall of the front part because of the different quantities of material used, makes it possible to obtain directly a relative position of the bevels along a direction which favors the folding of the membrane in the overlapping zone. Thus, when the article of footwear is closed, the pliant membrane folds back inwardly toward the shoe and comes in contact with the leg in a zone situated in front of the ankles, thereby improving the grip of the foot.

It will also be observed that the open position of the article of footwear of the present invention is its stable or rest position, so that it can be put on (or even removed) without separating manually the parts connected by the pliant membrane (i.e., without having to unfold the latter).

Finally, it should be emphasized that the article of footwear can also include fastening means in the boot and/or "berlingots" composed of self-molding, form-fitting material for specific areas of the foot (e.g., the ankles) to improve the grip of the foot. These additional means can be achieved according to the process of the invention or inserted afterwards.

Several variations of a preferred embodiment of the article of footwear and manufacturing process of the present invention will now be described by way of example with reference to the accompanying drawings, in which:

FIG. 4 is a side view of the article of footwear manufactured according to the process of the invention, emerging from the mold in stable, open position.

FIG. 5 is a cross-section along line V—V of FIG. 4 showing, in the stable position, the flexible connecting membranes of the movable front and rear parts of the shoe.

FIG. 6 is a cross-section along line V—V of FIG. 4, showing the rear part in closed position, the membranes buckling together in the forward direction.

FIG. 1 illustrates more specifically a shoe (1), an article of footwear composed of a part (2) to be placed on the foot, a front part (3) and a rear part (4) surrounding the lower part of the leg.

Figure 1:
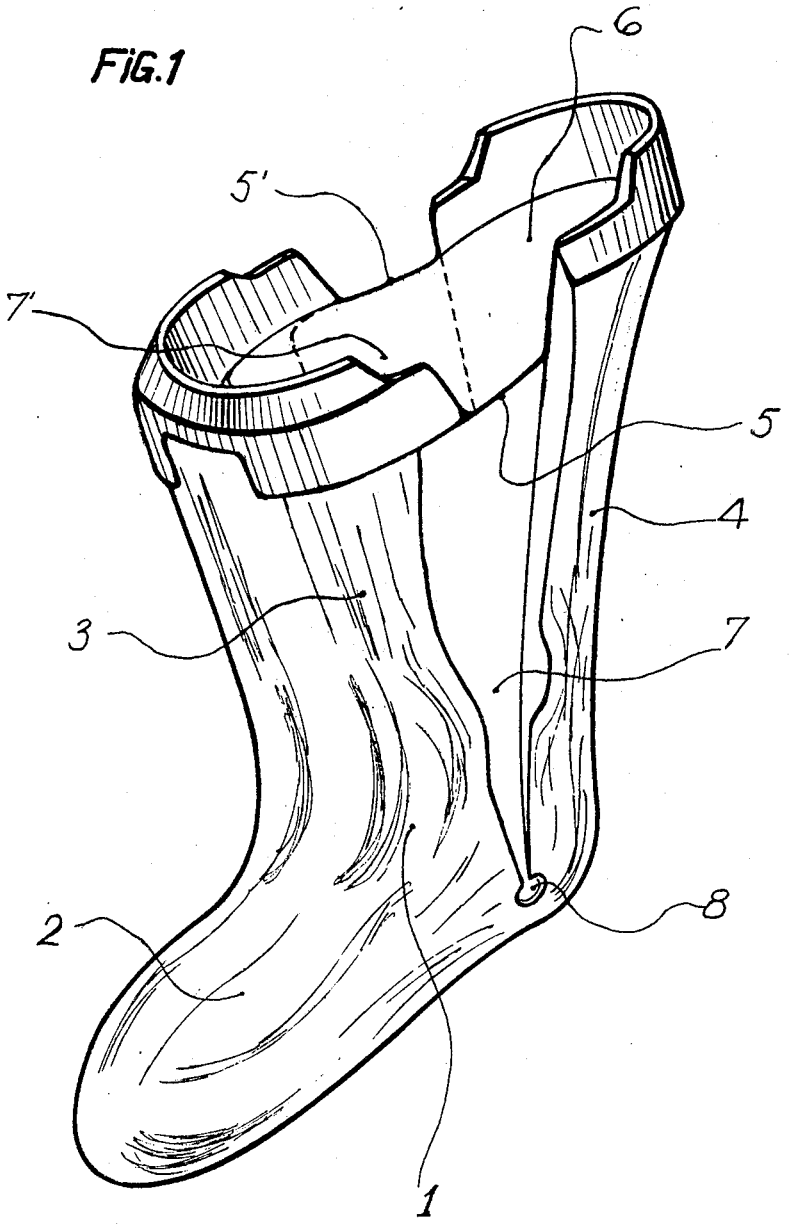
FIG. 1 is a perspective view of the article of footwear fabricated according to a preferred method of embodiment of the process of the invention.

The two pliable membranes (5, 5') situated along the lower part of the leg originate from the lateral walls of an expandable cloth sock (6) on which the shoe is molded in a stable open position; they appear in the area of said opening slots.

In the closed position of use, the front (3) and rear (4) parts are drawn together; a clearance (8) facilitates the pivoting of the parts together.

Figure 2:
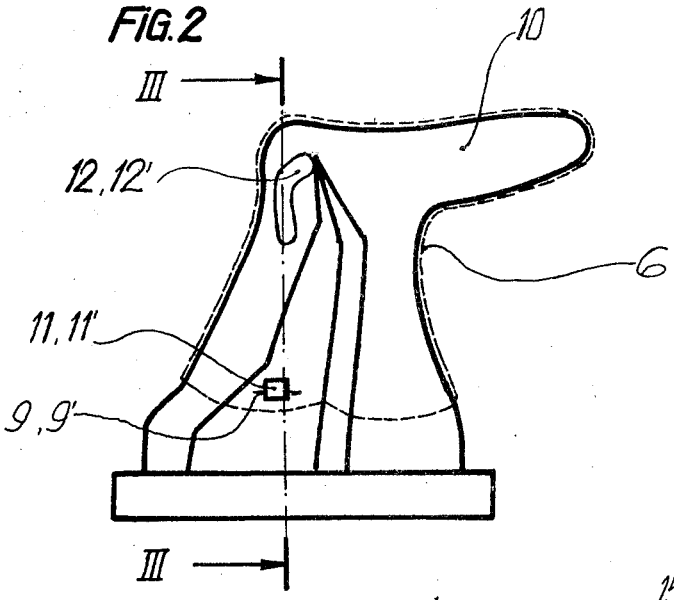
FIG. 2 is a front view of the core used for the manufacturing process of the article of footwear and on which a cloth sack is placed.

FIG. 2 shows the general shape of the core (10) on which is placed a sock (6) (dotted line) made of expandable material for easy adaptation to the shape of said core. On a level with the lower leg area, the core is extremely flared in shape, corresponding to a maximum opening of the shoe. On each side of the core, fastening means (11, 11') are provided for attaching the sock by means of eyelets (9, 9') provided for this purpose and for stretching the latter perfectly over said core. Plates made of self-molding material (12, 12') are glued or otherwise attached to the sock in the zone corresponding to the hollow behind the ankles, so that they can be remolded with said sock.

Figure 3:
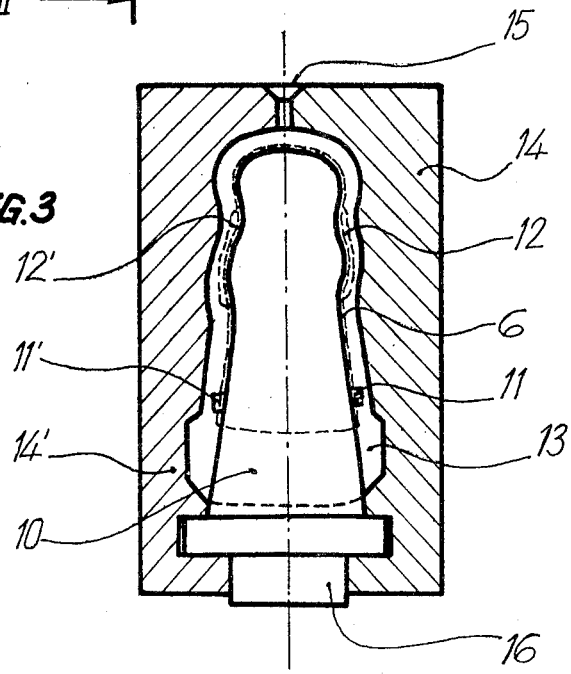
FIG. 3 shows a cross-section along line III—III of FIG. 2, illustrating the mold-core unit in its injection position.

FIG. 3 shows a cross-section of the mold-core unit in the injection position. The core (10) is placed and positioned between the mold halves (14, 14') by centering means (16). The expanded synthetic substance is introduced through the injection hole (15) to the space (13) delimited by the core and hollow mold constituted by shells (14, 14'). The expanded synthetic substance duplicates the form of the sock (6) and its self-molding plates (12, 12'). The fastening means (11, 11') of the sock are embedded in the expanded synthetic substance.

FIG. 4 shows the shoe made according to the process of the invention leaving the mold in stable, open position, and includes anchoring means (17) from the molding or remolding process (18). Shown in fine, combined lines is the fin (19) which contains the block (such as 20 or 20') of molded material in which the sock (6) fastening (11, 11') and stretching means have been embedded; these are then cut out and eliminated. The front (3) and rear (4) parts in the stable, open position are separated naturally from one another by the width of the slots (7, 7') and are joined by joining membranes (5, 5') which seal said slots. The sections of vertical rims (21) and (22) of parts (3) and (4) are in the shape of bevels (24, 24') (25, 25'), the tapered part of which is the function point of flexible membranes (5, 5') as shown in FIG. 5, which shows a cross-section of the shoe in stable, open position.

FIG. 6 also represents a cross-section along line V—V, with the shoe in its closed position of use. The front part (3), whose bevels (25, 25'), outwardly directed, are shaped by two secanted curves, is contiguous with the rear part (4) which has moved forward. Each of the bevels (24, 24') of the latter, inwardly directed, has a specific shape defined by two almost parallel curves separated by a straight line extending from the exterior of the interior and from rear to front. The geometry of this relative arrangement of the bevels results in a specific shaping of the membranes (7, 7') which fold by buckling (26, 26') towards the front and inside of the shoe. The configuration of the folds (26, 26') of the membranes (7, 7') assures a better envelopment of the lower part of the leg.

Figure 7:
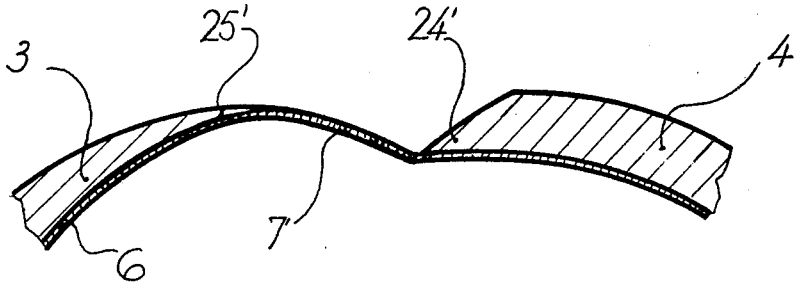
FIG. 7 is an enlarged detail of the cross-section along line V—V of FIG. 4 showing the relative position of the bevels connected by the pliable membrane after removal of the shoe from the mold.
Figure 8:
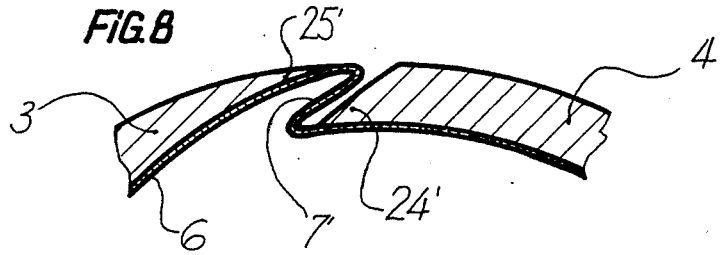
FIG. 8 shows the same detail as FIG. 7, illustrating the bevels and the fold of the membrane as the parts of the shoe upper are brought together.
Figure 9:
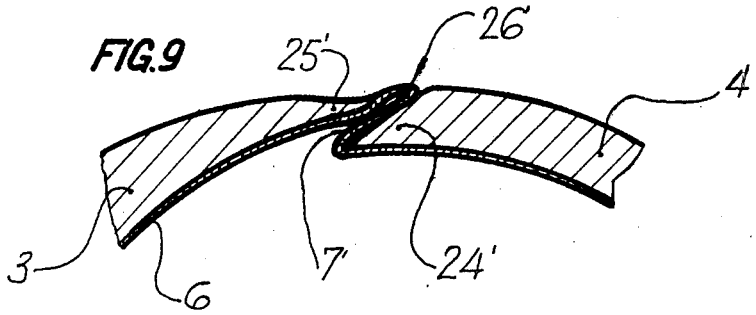
FIG. 9 shows the same detail as in FIG. 7, with the two parts of the shoe upper in closed position, the membrane between the bevels along its adjacent length.

FIGS. 7, 8 and 9 illustrate the folding stages from open to closed position where the bevels join with the membrane. In the open position (FIG. 7), it can be seen that the bevel (24') of the rear part (4) which has more of a molding recess than that of the front part (3) because of the greater amount of material, is inwardly directed. The result of this is to locate the bevel (25') of the front part (3) outside of bevel 24' and thereby enable the membrane (7) to buckle inside the article of footwear. In the closing position (FIG. 8), the relative outward displacement of the bevel (25') in relation to bevel 24' additionally emphasizes the buckle shape of the membrane (7') located between them. In the closed position (FIG. 9), the fold (26') of the membrane (7') is totally covered and inserted between the two bevels (in the overlapping zone), thus creating a zone whose thickness is at most equal to that of the parts of the shoe upper.

What is claimed is:

1. Molding process for an article of footwear to be placed in a boot, said article of footwear being molded as a single piece with its upper part having substantially the shape of said article in its open position, whereby said article can be conveniently put on and taken off.

2. Process according to claim 1, including the steps of (a) molding the article of footwear by placing a core inside a hollow mold;

(b) injecting synthetic matter into the space provided between said core and said mold;

(c) removing said article of footwear by extracting the inner core, the article of footwear being open in the position for putting it on and removing it;

(d) the inner core having a lower part in the shape of a foot and being extended by an upper part having substantially the shape of the volume delimited by the article of footwear open in the slipping-on/slipping-off position;

(e) the hollow mold having in its lower part, the shape of the inside of the boot and, in its upper part, a practically flanged shape corresponding to the open position for putting on and taking off said article of footwear, whereby, on the one hand, the inner core can be conveniently extracted during the mold-stripping process, and, on the other hand, the skier can conveniently put on and take off the article of footwear.

3. Process according to claim 1, said footwear including at least one pliable zone allowing the closing of the article of footwear when it is put on the foot, wherein said pliable zone is created by connecting the edges of the article of footwear surrounding the pliable zone by a pliable membrane.

4. Process according to claim 3, wherein, in order to connect the edges of the article of footwear surrounding the pliable zone by a pliable membrane, a recess allowing the passage of the pliable membrane is provided between the inner core and the hollow mold on a level with the pliable zone.

5. Process according to claim 4, wherein, before molding, a sock is slipped over the inner core, said recess being at least as thick as the sock, so that the pliable membrane is at least constituted by said sock.

6. Process according to claim 3, wherein the recess communicates with the space between the core and the hollow mold, so that the pliable membrane is created directly when the article of footwear is molded.

7. Process according to claim 6, wherein the thickness of the recess is less than that of the space between the core and the hollow mold, so that the thickness of the pliable membrane is less than that of the article of footwear.

8. Process according to any of claim 3, wherein the edges of the hollow mold defining the pliable zone are bevelled in relationship to one another.

9. Molding process for an article of footwear to be placed in a boot, including the steps of (a) molding the article of footwear by placing a core inside a hollow mold;

(b) injecting synthetic matter into the space provided between said core and said mold;

(c) removing said article of footwear by extracting the inner core, the article of footwear being open in the position for putting it on and removing it;

(d) the inner core having a lower part in the shape of a foot and being extended by an upper part having substantially the shape of the volume delimited by the article of footwear open in the slipping-on/slipping-off position;

(e) the hollow mold having, in its lower part, the shape of the inside of the boot and, in its upper part, a practically flanged shape corresponding to the open position for putting on and taking off said article of footwear, whereby, on the one hand, the inner core can be conveniently extracted during the mold-stripping process, and, on the other hand, the skier can conveniently put on and take off the article of footwear.

* * * * *